United States Patent [19]

Johansson et al.

[11] Patent Number: 4,751,867

[45] Date of Patent: Jun. 21, 1988

[54] PRESSURE FLUID OPERATED CYLINDER DEVICE

[75] Inventors: Pär G. J. Johansson; Per-Olof H. Krantz, both of Boras, Sweden

[73] Assignee: Atlas Copco Aktiebolag, Nacka, Sweden

[21] Appl. No.: 275,442

[22] Filed: Jun. 19, 1981

[30] Foreign Application Priority Data

Jul. 10, 1980 [SE] Sweden ..... 8005068

[51] Int. Cl.[4] ..... F15B 15/22

[52] U.S. Cl. ..... 92/5 R; 91/1

[58] Field of Search ..... 91/1, 410, 361, 389; 92/5 R

[56] References Cited

U.S. PATENT DOCUMENTS

| | | | |
|---|---|---|---|
| 1,536,787 | 5/1925 | Grace | 91/351 |
| 1,643,671 | 9/1927 | Lower | 91/351 |
| 2,610,050 | 9/1952 | Dale | 91/1 |
| 2,959,156 | 11/1960 | Dreptin | 91/1 |
| 3,414,693 | 12/1968 | Watson et al. | 92/5 R |
| 4,309,936 | 1/1982 | Eberle et al. | 91/410 |

*Primary Examiner*—Robert E. Garrett

*Attorney, Agent, or Firm*—Eric Y. Munson

[57] ABSTRACT

A pressure fluid operated cylinder device having means to indicate that the piston (14) is at or near an end position. The indicating means comprises a rod-like member (1) which is actuated by the piston (14). The movement of rod (1) is transformed into a rotary movement by rack (2) and pinion (16). A cam (4) actuates a valve (5) or a microswitch (6).

6 Claims, 1 Drawing Sheet

PRESSURE FLUID OPERATED CYLINDER DEVICE

Figures 1A, 1B, 2:
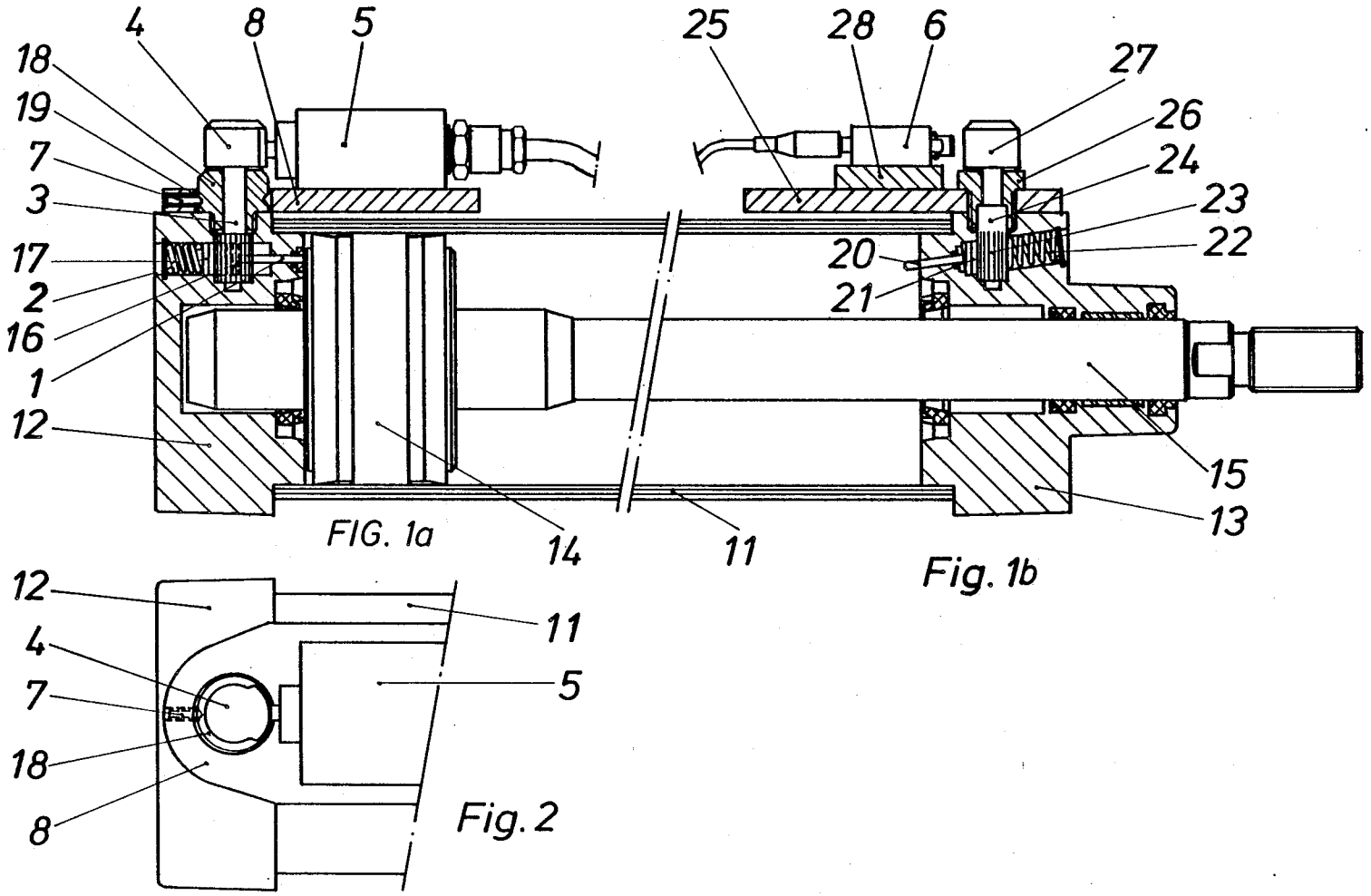

The present invention relates to a pressure fluid operated cylinder device having means to indicate that the piston is at or near one of its end positions or either of its end positions.

According to prior art, indications of the above mentioned type have been obtained either by providing the piston rod with cams, actuating valves or switches or by providing the piston with magnetic material for the actuation of reed relays.

A drawback with cams on the piston rod is that they may impose severe restrictions on the design of the cylinder device because these cams must not interfere with the operation of the cylinder device. This drawback is not present when the piston is provided with magnetic material. However, in that case the indication can only be obtained as an electric signal.

According to the present invention there is suggested a solution which does away with the above mentioned drawbacks. The invention is defined by the subsequent claim.

Two embodiments of the invention are described below with reference to the accompanying drawings in which FIG. 1*a* shows a section through a cylinder device according to one embodiment of the invention and FIG. 1*b* shows a section through a second embodiment.

FIG. 2 shows a view from above of the left part of the cylinder device according to FIG. 1*a*.

The cylinder device shown in the drawings is operated by compressed air. However, the invention is not restricted to the use of any particular fluid. The device comprises a cylinder 11 provided with end walls 12, 13. The end walls are provided with normal connections (not shown) for the supply and return of a working fluid. A piston 14 connected with a piston rod 15 is axially movable in the cylinder 11. A rod-like member 1 is disposed in end wall 12 and extending into cylinder 11 substantially parallel to the piston rod 15 so as to be actuatable by piston 14. Member 1 is connected with a rack 2 against which a spring 17 acts. Rack 2 cooperates with a pinion 16 which is connected with a shaft 3 extending to the outer surface of they cylinder device. Rack 2 and pinion 16 form together a gear means for transforming the linear movement of the rod-like member 1 into a rotary movement of shaft 3. Pinion 16 is held in position by a nut 18 screwed into end wall 12. Nut 18 functions as a journal for shaft 3. A cam 4 is either fixed or angularly adjustably mounted on shaft 3. A pneumatic vavle 5 being actuated by cam 4 is mounted on a plate 8. Plate 8 is angularly adjustable around nut 18 and locked by a screw 7 cooperating with an annular groove 19 in nut 18. This angular adjustability of plate 8 makes it possible to actuate valve 5 at somewhat different distances between piston 14 and end wall 12. The pneumatic valve 5 can be actuated by the rotational movement of cam 4 resulting from engagement of the piston 14 and the rod-like member 1. Actuation of the valve 5 provides a pneumatic signal which may be used as an indication of the position of the piston 14 within its cylinder 11. The cam 4 may be adjusted relative to the rotatable shaft 3 by conventional means to provide an inverse pneumatic output signal from the pneumatic valve 5.

In the embodiment shown on the right hand side of FIG. 1 the rod-like member 20 connected with rack 21 and the counteracting spring 22 are disposed in end wall 13 at an angle to the axis of the device. Rack 21 cooperates with a pinion 23 having a shaft portion 24. Pinion 23 and a mounting plate 25 are secured to end wall 13 by a nut 26 which acts as a journal for shaft 24. A cam 27 is preferably angularly adjustably mounted on shaft 24. A microswitch 6 is mounted on a further plate 28 which may be fixed on or adjustably mounted on plate 25. Microswitch 6 is actuatable by cam 27.

The above described and in the drawings shown embodiments of the invention are only to be regarded as examples which may be modified within the scope of the subsequent claims.

We claim:

1. In a pressure fluid operated cylinder device including a cylinder having first and second end walls and a piston movable within said cylinder between said end walls, the improvement comprising:

a rod-like member mounted to one of said first and second end walls and not directly mounted to said piston, said rod-like member extending into said cylinder along a plane substantially parallel to the plane of said piston, said rod-like member being spring biased in a direction towards said piston within said cylinder, said rod-like member being movable against the direction of said spring bias by said piston, gear means operatively coupled to said rod-like member for transforming linear motion of said rod-like member into rotational movement, a shaft operatively coupled to said gear means at one end of said shaft, said other end of said shaft extending through said cylinder, said shaft being rotated by said gear means when said rod-like member is moved by said piston, a cam mounted to said other end of said shaft extending through said cylinder, said cam being rotatable with said shaft, signal generation means positioned outside of said cylinder and proximate to said cam, said signal generation means being operatively associated with and actuable by said cam mounted to said rotatable shaft, and means for adjusting the relative position of said cam and said signal generation means for varying the position within said cylinder at which said piston actuates said signal generation means.

2. The device of claim 1 wherein said signal generation means includes a pneumatic valve.

3. The device of claim 1 wherein said signal generation means includes a microswitch.

4. The device of claims 2 or 3 wherein said gear means includes a rack and pinion in which said rack is connected to said rod-like member and said pinion is connected to said shaft.

5. In a pressure fluid operated cylinder device including a cylinder having first and second end walls and a piston movable within said cylinder between said end walls, the improvement comprising:

a first rod-like member mounted to said first end wall and not directly mounted to said piston, said first rod-like member extending into said cylinder along a plane substantially parallel to the plane of said piston, said first rod-like member being spring biased in a direction towards said piston within said cylinder, said first rod-like member being movable against the direction of said spring bias by said piston, a second rod-like member mounted to said second end wall and not directly mounted to said piston, said second rod-like member extending into said cylinder along a plane substantially parallel to the plane of said piston, said second rod-like member being spring biased in a direction towards said piston within said cylinder, said second rod-like member being movable against the direction of said spring bias by said piston, first gear means operatively coupled to said first rod-like member for transforming linear motion of said first rod-like member into rotational movement, second gear means operatively coupled to said second rod-like member for transforming linear motion of said second rod-like member into rotational movement, a first shaft operatively coupled to said first gear means at one end of said first shaft, said other end of said first shaft extending through said cylinder, said first shaft being rotated by said first gear means when said first rod-like member is moved by said piston, a second shaft operatively coupled to said second gear means at one end of said second shaft, said other end of said second shaft extending through said cylinder, said second shaft being rotated by said second gear means when said second rod-like member is moved by said piston, a first cam mounted to said other end of said first shaft extending through said cylinder, said first cam being rotatable with said first shaft, a second cam mounted to said other end of said second shaft extending through said cylinder, said second cam being rotatable with said second shaft, a pneumatic valve operatively associated with said first cam for actuation by said first cam when said piston moves against said first shaft mounted to said first end wall, a microswitch operatively associated with said second cam for actuation by said second cam when said piston moves against said second shaft mounted to said second end wall, and first means for adjusting the position of said first cam and said pneumatic valve to vary the position of said piston that will actuate said pneumatic valve.

6. The device of claim 5 further including:

second means for adjusting the relative position of said second cam and said microswitch to vary the position of said piston that will actuate said microswitch.

* * * * *